US006704973B1

(12) United States Patent
Naham

(10) Patent No.: US 6,704,973 B1
(45) Date of Patent: Mar. 16, 2004

(54) DEVICE FOR FACILITATING BUTTON ENGAGEMENT

(76) Inventor: Milton Naham, Ellen Dr., Rockaway, NJ (US) 07866

( * ) Notice: Subject to any disclaimer, the term of this patent is extended or adjusted under 35 U.S.C. 154(b) by 0 days.

(21) Appl. No.: 10/122,934

(22) Filed: Apr. 16, 2002

Related U.S. Application Data

(60) Provisional application No. 60/294,126, filed on May 30, 2001.

(51) Int. Cl.[7] ..... A41F 1/02; A44B 1/00; A44B 6/00; B25F 1/00

(52) U.S. Cl. ..... 24/40; 24/41; 24/56; 7/123; 7/169

(58) Field of Search ..... 24/40, 41, 56; 7/123, 169

(56) References Cited

U.S. PATENT DOCUMENTS

| | | | | | |
|---|---|---|---|---|---|
| 27,252 | A | * | 6/1860 | Haskett | 24/40 |
| 31,433 | A | * | 8/1861 | Clarkson | 24/40 |
| 240,632 | A | * | 4/1881 | Adamson | 24/40 |
| 441,577 | A | * | 11/1890 | McMurray | 24/24 |
| 615,482 | A | * | 12/1898 | Gans | 24/40 |
| 825,790 | A | * | 7/1906 | York | 24/40 |
| 894,190 | A | * | 7/1908 | Crane | 7/123 |
| 901,210 | A | * | 10/1908 | Tarrant | 24/40 |
| 903,320 | A | * | 11/1908 | Rivoire | 24/40 |
| 976,098 | A | * | 11/1910 | Robison | 24/40 |
| 1,084,399 | A | * | 1/1914 | Collins | 24/40 |
| 1,125,429 | A | * | 1/1915 | Woomert | 24/40 |
| 1,306,790 | A | * | 6/1919 | Vogel | 24/40 |
| 1,463,400 | A | * | 7/1923 | Neumann | 24/56 |
| 2,461,639 | A | * | 2/1949 | Grigalunas | 7/123 |
| 3,738,480 | A | * | 6/1973 | Chesley | 206/42 |
| 5,276,948 | A | * | 1/1994 | Steadman | 24/40 |
| 5,337,457 | A | * | 8/1994 | Chennault | 24/56 |
| 6,446,312 | B1 | * | 9/2002 | Kabat | 24/40 |

* cited by examiner

*Primary Examiner*—Victor Sakran
(74) *Attorney, Agent, or Firm*—Charles E. Temko

(57) ABSTRACT

A hand held device for facilitating the engagement of buttons on a garment particularly suited for use by older persons who have difficulty with manual manipulation. The device includes a hooklike terminal having an opening of varying width for engaging the interconnection between the button and the garment in the form of threads or a shank.

4 Claims, 1 Drawing Sheet

DEVICE FOR FACILITATING BUTTON ENGAGEMENT

RELATED APPLICATION

Reference is made to my co-pending provisional application for letters patent Ser. No. 60/294,126 filed May 30, 2001, to which a claim of priority is made.

BACKGROUND OF THE INVENTION

This invention relates generally to the field of manually operated tools, and more particularly to a tool for use by older persons, and those having difficulty in manipulating their fingers.

Button hook devices for use with boots and shoes are well known in the art. Such devices normally include a handle from which a relatively stiff wire extends, the wire having a free open end forming a generally circular hook which can be passed through a buttonhole to engage a button or other enlargement and guided through a corresponding buttonhole. While such devices are not without utility, they are not easy to use in the buttoning of garments upon a user because of excess length, and the inability of the hook to pass over buttons of relatively flat configuration to engage the threads interconnecting the button with the garment, or the shank of the button in the case of a shank button. Normally, the garment is of relatively limp cloth, rather than relatively stiff leather, and the button upon engagement will not remain in fixed position for easy engagement with the tool.

SUMMARY OF THE INVENTION

Briefly stated, the invention contemplates the provision of an improved tool of the type described in which the above described disadvantages have been eliminated or at least substantially ameliorated. To this end, the disclosed device comprises a molded or stamped generally planar tool of metal or synthetic resinous materials, one end of which forms a hook like opening in which the configuration is generally tapered toward that end, there being an entrance slot from the periphery of the device leading to the opening. In use, the threaded shank is passed through the slot to be engaged by the tapered end, such that the surrounding surface of the device may be engaged with the undersurface of the generally planar button. The tool then exerts a guiding action to pass the button through the corresponding buttonhole following which the device is disengaged.

In the case of very small buttons, the opening forming the hook may pass over the button during engagement. In the case of larger buttons, the hook end of the device is inserted in the buttonhole and is moved to directly engage the interconnecting threads or shank. In the alternative, the device may be also formed as a metallic stamping.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
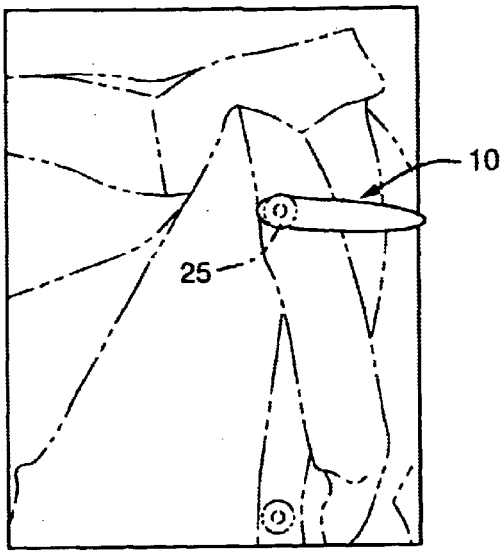
FIG. 1 is a view in perspective showing an embodiment of the device in engaged position relative to a garment.
Figure 2:
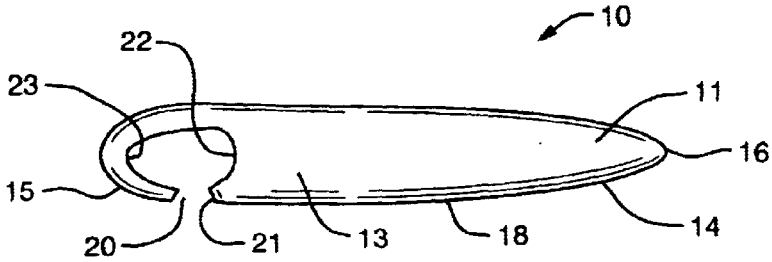
FIG. 2 is a view in elevation of the device in detached condition.

In accordance with the invention, the device, generally indicated by reference character 10 comprises an elongated body 11 formed as a synthetic resinous or metallic molding. In the alternative, it may be formed as a metallic stamping. The body includes first and second planar services, one of which is indicated by reference character 13 and is bounded by a peripheral edge 14 between first and second end portions 15 and 16. The periphery includes first and second side edges 17 and 18.

Adjacent to first end 15 is an entrance slot 20 of width sufficient to permit passage of threaded interconnection or a shank of a button 25. The slot 20 leads to a tapered opening 21 having a larger generally arcuate end 22 and a smaller tapered end 23, the direction of taper being toward the first end portion 15.

FIG. 1 in the drawing illustrates the use of the device in buttoning a garment, such as a shirt having relatively small buttons where the diameter of the same is slightly larger than that of the size of the opening 21. It is noted that the device may also be used with a smaller button (not shown) which is at least as large as the tapered portion of the opening.

Figure 3:
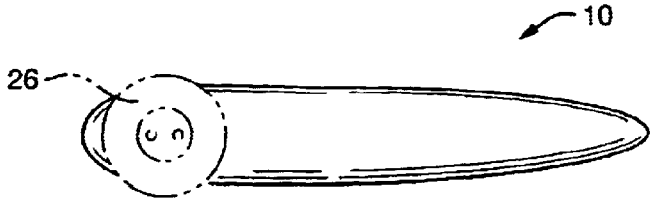
FIG. 3 is an elevational view showing the device in engaged condition with a relatively smaller button.

FIG. 3 illustrates the use of the device with a somewhat larger button 26 as might be used on a sweater.

Figure 4:
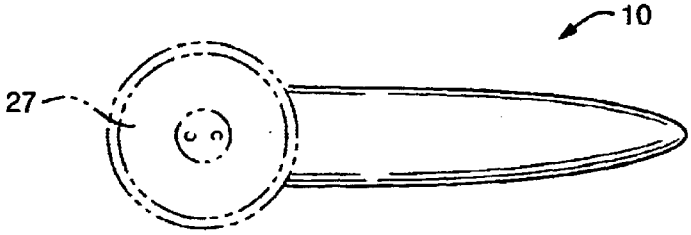
FIG. 4 is a similar view in elevation showing engaged condition of device with a relatively larger button.

FIG. 4 illustrates the use of the device with a still larger button 27 as might be used with an outer garment such as a coat.

In each case, the threaded or shank interconnection of the button will be engaged with the tapered opening such that the outer surface of the device will engage the undersurface of the button to guide the button through the corresponding buttonhole. Because the device is of generally planar configuration, as distinguised from wire like configuration, it may be of relatively short length, typically two to three inches, and while one planar surface engages the undersurface of the button, the other planar surface is adapted to engage the edge of the corresponding buttonhole and keep it in relatively spread condition to facilitate the passing of the button therethrough. Once this has been accomplished, the button will remain in relatively stable position, and the device may be readily disengaged without further disturbing the buttonhole.

I wish you to be understood that I do not consider the invention to be limited to the precise details of structures shown and set forth in the specification, for obvious modifications will occur to those skilled in the art to which the invention pertains.

I claim:

1. A device for facilitating the engagement of a button with a corresponding buttonhole in a garment, said device comprising a generally planar elongated body having first and second ends and a peripheral edge; said body and said first end defining an entrance slot leading to an opening through said body, said opening being of tapered configuration in a direction towards said first end; whereby during employment, said first end of said body is passed through said buttonhole to engage the edge of said opening; and means interconnecting said button with said garment, and underlying a surface of said button to enable guidance of said button through said buttonhole.

2. A device in accordance with claim 1 in which said body is in the form of a molding of synthetic resinous material.

3. A device in accordance with claim 1 in which said device is in the form of a molding of metallic material.

4. A device in accordance with claim 1 in which said body is in the form of a metallic stamping.

* * * * *